US008322550B2

(12) United States Patent
Jansen

(10) Patent No.: US 8,322,550 B2
(45) Date of Patent: Dec. 4, 2012

(54) DOOR CLOSING MECHANISM

(76) Inventor: Garry L Jansen, Clarkesville, GA (US)

( * ) Notice: Subject to any disclaimer, the term of this patent is extended or adjusted under 35 U.S.C. 154(b) by 242 days.

(21) Appl. No.: 12/857,818

(22) Filed: Aug. 17, 2010

(65) Prior Publication Data

US 2011/0041410 A1 Feb. 24, 2011

Related U.S. Application Data

(60) Provisional application No. 61/235,198, filed on Aug. 19, 2009.

(51) Int. Cl.
*B65D 90/02* (2006.01)

(52) U.S. Cl. ..... 220/1.5; 220/817

(58) Field of Classification Search ..... 220/1.5, 220/324, 834, 817; 49/382, 193; 292/DIG. 17, 292/157, 158, 159, 160, 166, 167, 168, 172, 292/174, 142; 312/324
See application file for complete search history.

(56) References Cited

U.S. PATENT DOCUMENTS 5,829,197 A * 11/1998 Oh ..... 49/193
* cited by examiner

*Primary Examiner* — Stephen Castellano
(74) *Attorney, Agent, or Firm* — Defillo & Associates, Inc.; Euelyn A. Defillo

(57) ABSTRACT

The present invention relates to a hydrotherapy device comprising at least one door which is operable between an open condition in which access is provided to the interior of the device and a closed condition in which access is prevented to the interior of the device. The door closing mechanism according to the present invention may be designed to quickly provide either a "left hand" or a "right hand" configuration to the door.

4 Claims, 7 Drawing Sheets

DOOR CLOSING MECHANISM

REFERENCE TO RELATED APPLICATIONS

This application is a non-provisional application of Provisional Application No. 61/235,198 filed Aug. 19, 2009, the entire contents of which are incorporated herein by reference.

FIELD OF THE INVENTION

This invention relates to hydrotherapy apparatus. More particularly, the present invention relates to a door latch mechanism for a hydrotherapy device. Furthermore, the present invention relates to a door closing mechanism in general.

BACKGROUND OF THE INVENTION

Recently, the use of hydrotherapy devices is becoming very popular. These devices are being widely used in the field of physiotherapy and rehabilitation of humans and animals. In addition, hydrotherapy devices are being used in health and athletic clubs and in residential homes. Basically, the known hydrotherapy devices generally include a receptacle having one or more glass sides, together with a conveyor in the bottom of the tank. The receptacle is generally filled with warm water, and the human or animal to be treated is placed inside the receptacle. The water provides the user with buoyancy allowing reducing the weight on the legs of the user necessary to contact the conveyor; thus, the user may exercise by the movement of the conveyor.

However, the known hydrotherapy devices present certain disadvantages. For instance it has previously been difficult to allow the user to enter and exit the hydrotherapy device. In addition, it is desirable to allow the device to be fully cleaned and the conveyor in the bottom of the receptacle may provide an obstacle for cleaning the device. Furthermore, it has the inability for the user to configure, as needed, the doors of the hydrotherapy device to either a left hand or a right hand configuration.

In addition, it is difficult to manually adjust the belt tension on the hydrotherapy devices of the prior art because generally they required idler rollers on the backside of the conveyor.

As can be seen, there is a need for a hydrotherapy device that allows to easily configuring, in-situ, the doors of the device to either a left hand or a right hand configuration. In addition, there is a need for a hydrotherapy device that allows the easy cleaning of the bottom of the device. Furthermore, there is a need for a hydrotherapy device that allows to automatically adjusting the belt tension.

SUMMARY OF THE INVENTION

In one aspect of the present invention the door system includes a receptacle having an open end, a door frame, and a closing mechanism. The closing mechanism includes a first engagement section operatively connected to a second engagement section. The first engagement section is connected to the open end of the receptacle and the second engagement section is connected to the door frame. The door system can be quickly converted from a left handle configuration to a right handle configuration or from a right handle configuration to a left handle configuration.

In one aspect of the present invention the door system includes a receptacle having an open end, a door frame, and a closing mechanism. The closing mechanism includes a first engagement section operatively connected to a second engagement section. The first engagement section is connected to the open end of the receptacle and includes a fixed pivot pin located on each corner of the open end. The second engagement section is connected to the door frame and includes on each one of the first side and second side of the top side of the door frame an upper sliding latch. The second engagement section includes on each one of the first side and second side of the bottom side of the door frame a lower sliding latch. The upper sliding latch and the lower sliding latch of each side are interconnected by a drive shaft. A removable handle simultaneously moves the upper sliding latch and the lower sliding latch on one side to engage with the corresponding fixed pivot pin on the open end of the receptacle. The handle moves from the first side of the door frame to the second side of the door frame to quickly convert from a left handle configuration to a right handle configuration or from a right handle configuration to a left handle configuration.

BRIEF DESCRIPTION OF THE DRAWINGS

For a fuller understanding of the nature and objectives of the invention, reference should be made to the following detailed description taken in connection with the accompanying drawings in which.

DETAILED DESCRIPTION OF THE INVENTION

Figure 1:
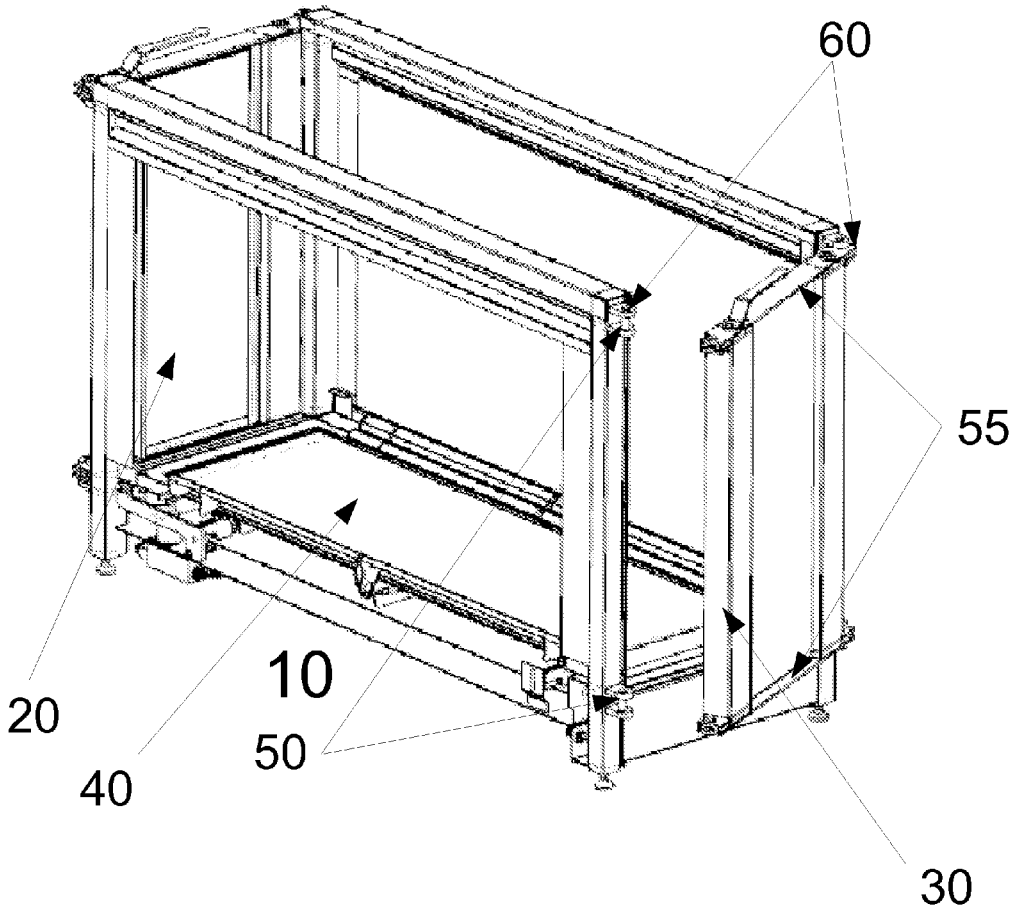
FIG. 1 illustrates a perspective front view of the hydrotherapy device of the present invention showing the door closing mechanism.
Figure 2:
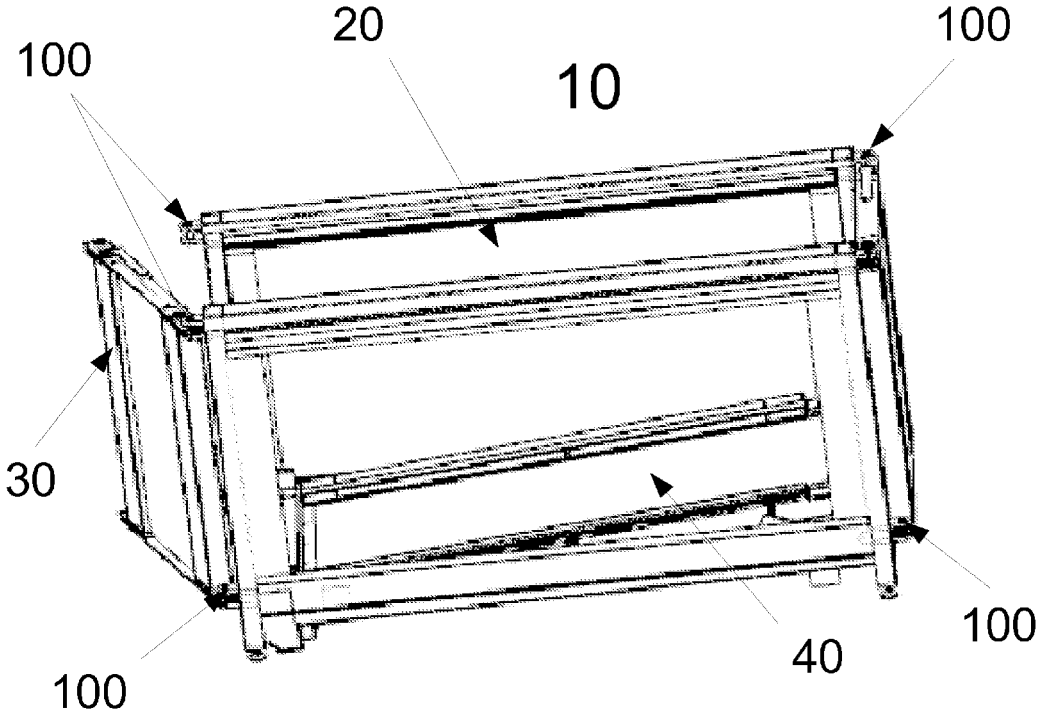
FIG. 2 illustrates a perspective side view of the hydrotherapy device of FIG. 1 including the door closing mechanism.
Figure 3:
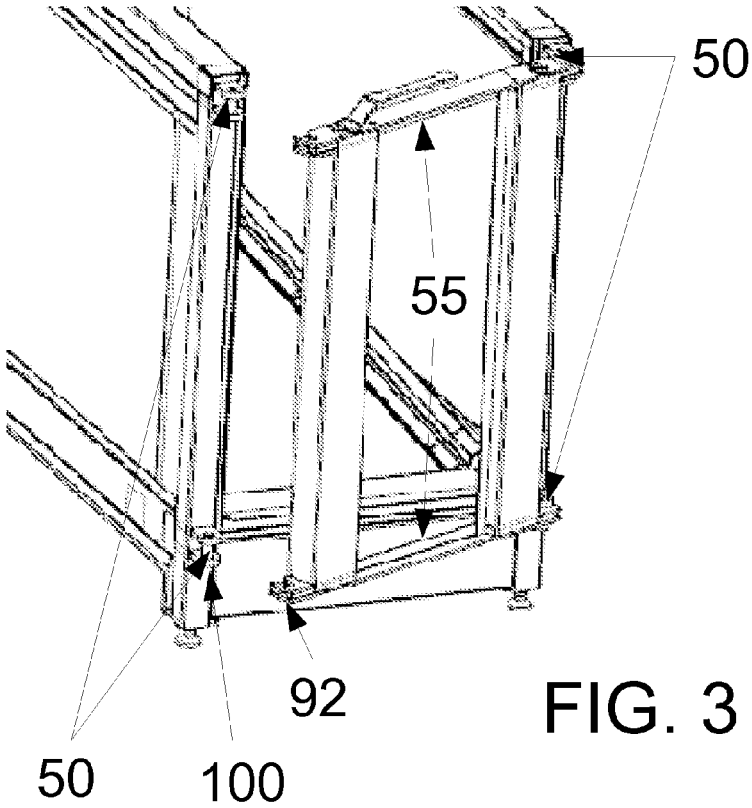
FIG. 3 illustrates a side view showing the details of the door closing mechanism according to the present invention when the door is configured for a right hand person.
Figure 4:
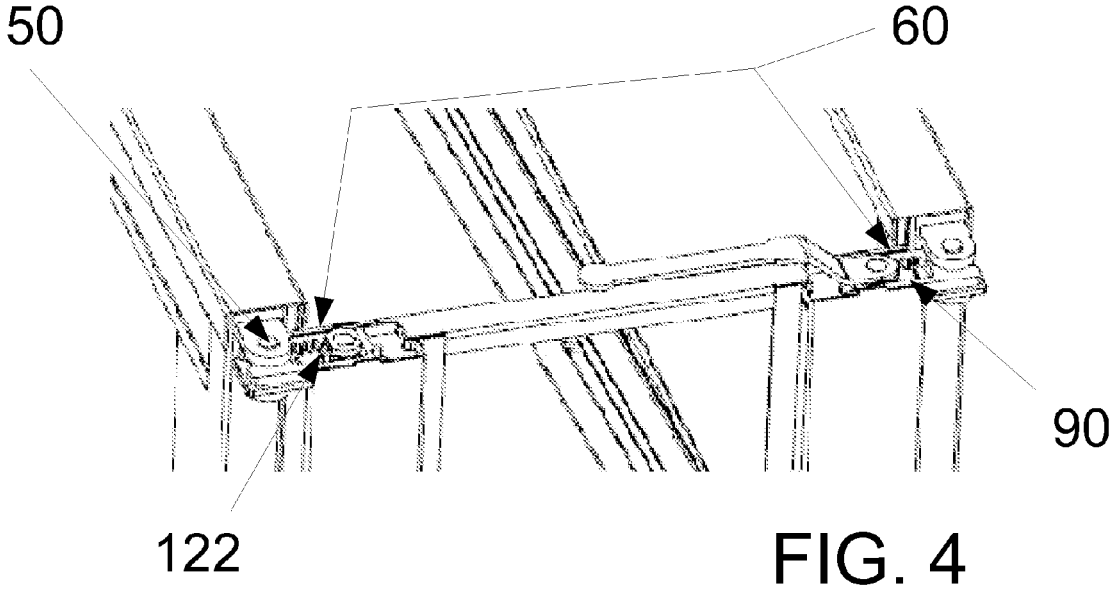
FIG. 4 illustrates a top view showing the door closing mechanism according to the present invention when the door is configured for a left hand person.

The present invention relates to a hydrotherapy device comprising at least one door which is operable between an open condition in which access is provided to the interior of the device and a closed condition in which access is prevented to the interior of the device. The door closing mechanism according to the present invention may be designed to quickly provide either a "left hand" or a "right hand" configuration to the door.

Although the invention has wider applicability, it is convenient to discuss the invention in relation to hydrotherapy devices and such reference to hydrotherapy devices hereinafter should not be taken to be limiting. The door closing system according to the present invention may be used in connection with any receptacle on which it is desirable to quickly switch the door configuration from left handed to right handed and vice versa.

The hydrotherapy device 10 includes a receptacle 20 having at least one door 30 operable between an open position to provide access to the interior of the device 10 and a closed position to prevent access to the interior of the device 10. In one embodiment, a conveyor belt 40 may be placed on the bottom of the receptacle 20. The conveyor belt 40 may provide the user with a surface to be walked upon.

The receptacle 20 may be made of a non-corrosive material. In one embodiment, the receptacle 20 may be made of plastic, metal, or glass. In one embodiment, the receptacle 20 may have at least one transparent wall. In one embodiment, the receptacle may be filled with a liquid. In one embodiment, the liquid may be heated water.

The door 30 may include a door closing mechanism 60. The door closing mechanism 60 may include two engagement sections operatively connected. The first engagement section 50 may be attached to an open end of the receptacle 20. The second engagement section 55 may be attached to the frame of the door 30.

The first engagement section 50 may include a fixed pivot pin 100 located on each corner of the open end of the receptacle 20.

Figure 5:
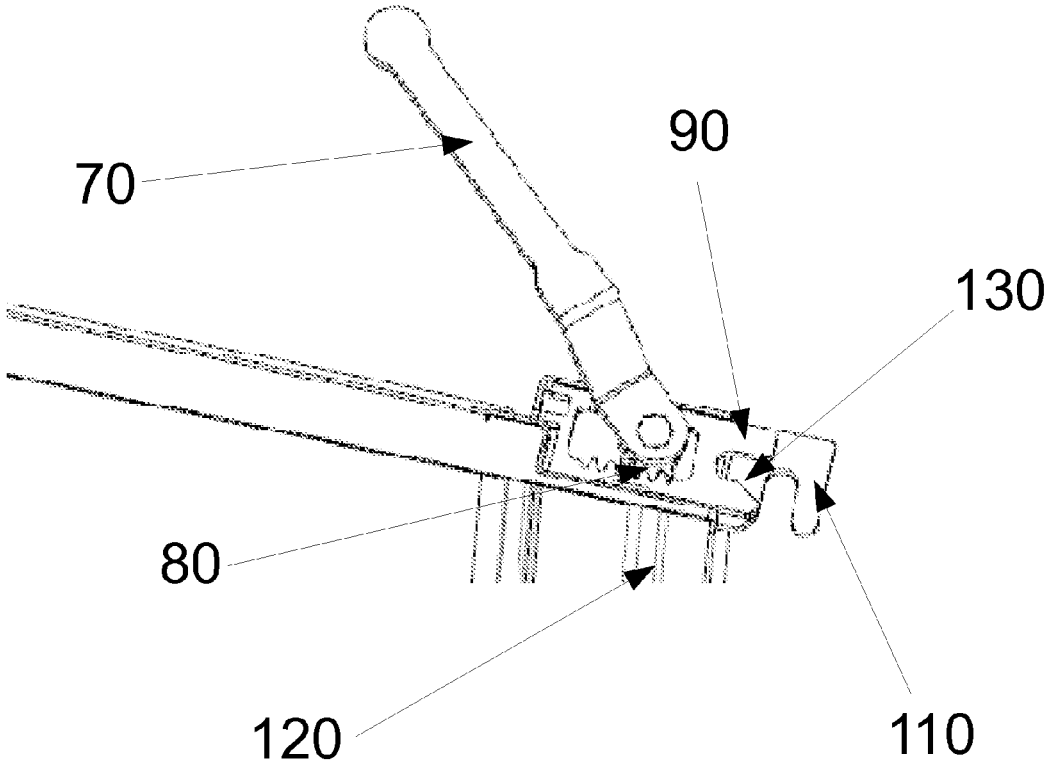
FIG. 5 illustrates a detail view of the upper section of the door closing mechanism according to the present invention.
Figure 6:
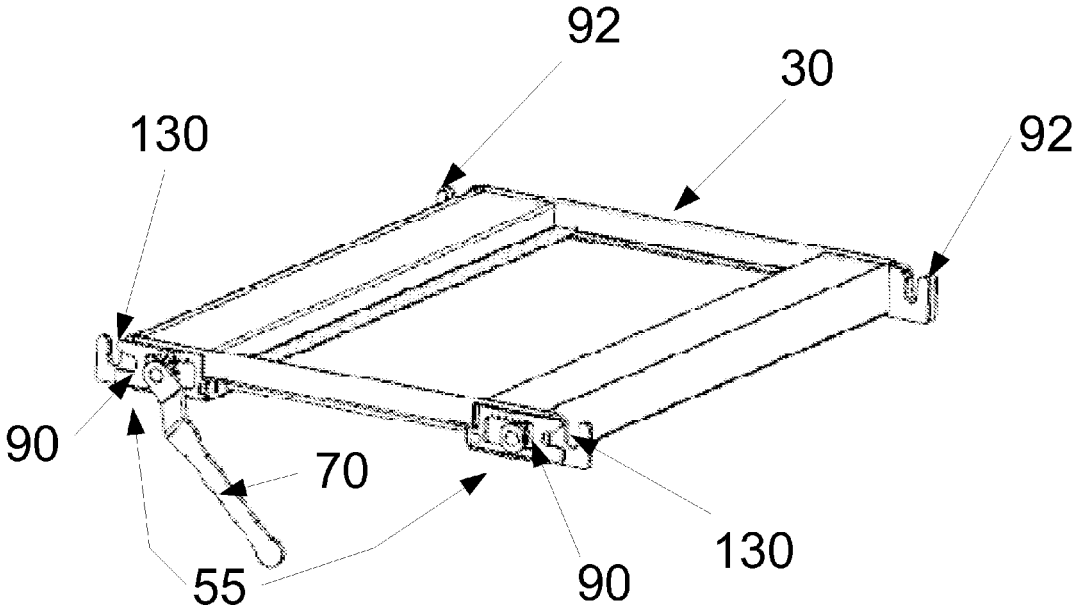
FIG. 6 illustrates a perspective side view of the door frame including one of the sections of the door closing mechanism attached to it.
Figure 7:
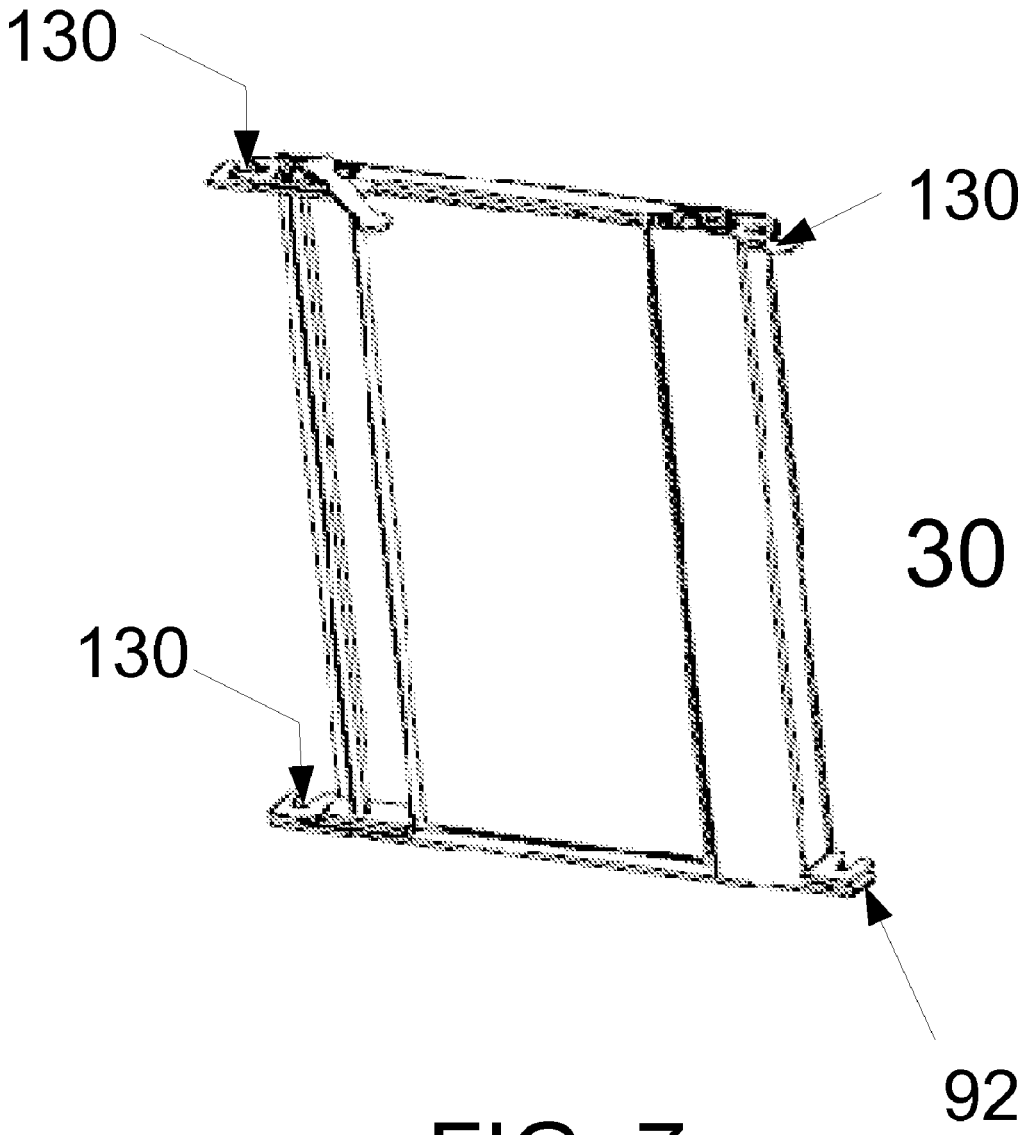
FIG. 7 illustrates a perspective front view of the door frame of FIG. 7.
Figure 8:
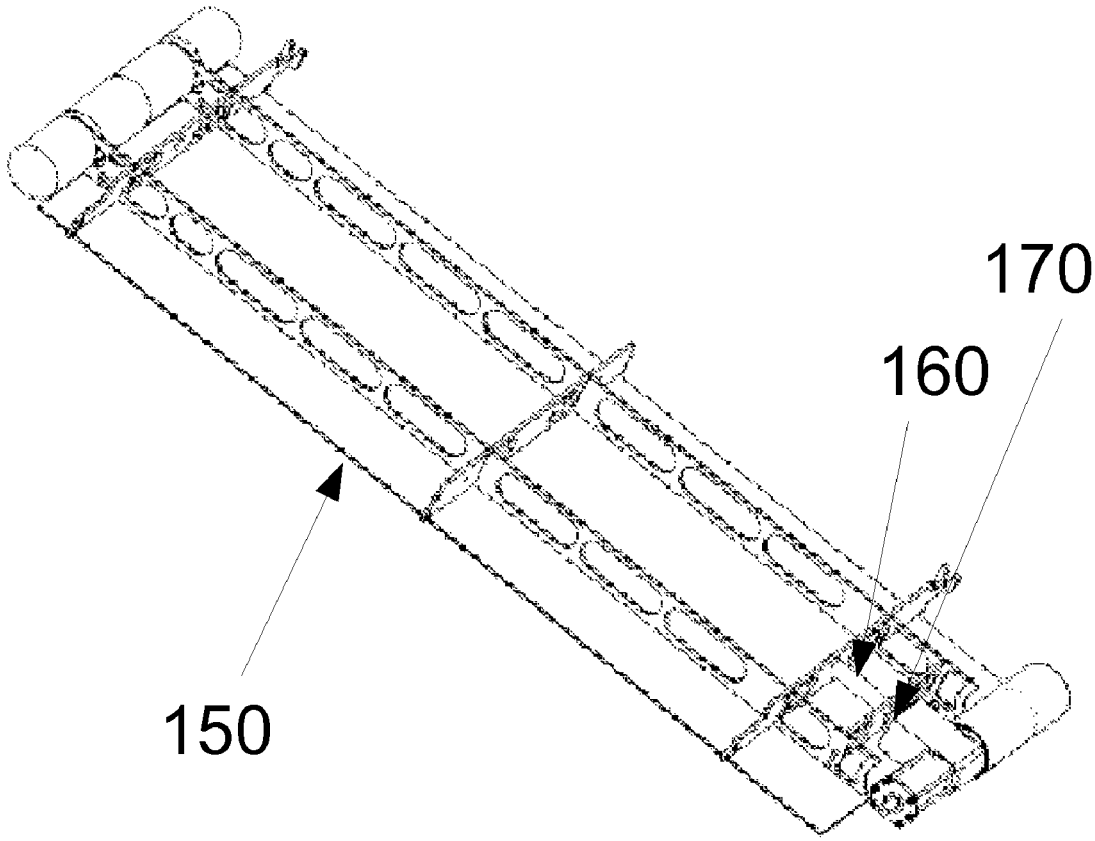
FIG. 8 illustrates a perspective front view of the idler roller assembly according to one embodiment of the present invention.

The second engagement section 55 may include on each one of the sides of the top of the door frame 30 an upper sliding latch 90. Each one of the sides of the bottom of the door frame includes a lower sliding latch 92. The upper sliding latch 90 and the lower sliding latch 92 on each side of the door frames may be interconnected by a drive shaft 120 (FIG. 5).

Each upper sliding latch 90 may include a slot 130 that engages with the corresponding fixed pivot pin 100 of the open end of the receptacle 20 during the operation of the closing mechanism 60. The slot 130 may have any suitable shape. In one embodiment, the slot 130 may be a U-shaped slot. In one embodiment, the slot 130 may have a V-shape.

The guide plates 110 on one side of the door frame are engaged with the corresponding fixed pivot pin 100 and a handle 70 may be temporally pivotally attach to the drive shaft 120. In one embodiment, a cam 80 may be arranged to rotate as the handle 70 moves from a first position to a second position. Rotating the handle 70 rotates the cam 80 and the drive shaft 120 which drives simultaneously the upper sliding latch 90 and the lower sliding latch 92 of one side of the door frame into the respectively fixed pivot pins 100, trapping the pins 100 and creating a hinge point for the door on that side of the door frame.

The door closing mechanism 60 of the present invention may be designed in such a manner that one or more points of engagement on the two sections 50, 55 are executed simultaneously with a rotation of the handle 70. In normal operation, only one side of the door frame 30 may be active and the remaining side may be a hinge point.

The handle 70 may be removed and placed in the other side of the door frame 30 when changing the door configuration from left handed to a right handed or vice verse. A cap 122 may be placed above the upper end of the drive shaft 120 to lock the position of the drive shaft 120. The cap 122 may also be moved from the left drive shaft to the right drive shaft depending on the selected door configuration. The fixed pivot pins 100 on the receptacle open end are then securely locked in the guides and latch locking throats, providing maximum structural integrity to the receptacle.

Rotating the handle 70 on the other side of the door frame 30 will operate in the same manner.

The final position of the door closing mechanism 60 relative to the door gasket is controlled by the stationary pin adjustment. Design of stationary pins provides for a secure field adjustable position and prevents movement in all directions. Benefits are the ability to configure the doors in a manner that promotes the best traffic flow in the installed location, provide easy removal to clean and service the door gasket, and easily adjustable door seal compression control.

In another aspect of the invention, the power roller for the conveyor belt may be fed with a hydraulic supply using an environmentally friendly fluid that is controlled in a manner in which speed control valves or variable displacement pumps are not required as in typical variable speed drive systems of this nature. This valveless design incorporates a fixed displacement pump driven by a variable speed prime mover controlled electronically and located remotely from the hydrotherapy device, eliminating the need for high power electronics in the "wet" area. The valveless design provides for higher efficiency, quieter operation, improved reliability, and a more compact design. Integral to the drive design is the ability to adjust the desired automatic tension force on the conveyor belt. Rear idler roller design uses internally positioned bearing blocks to provide adjustment for setting the belt tracking, as well as the design eliminated external shaft bearings, allowing rapid removal of the belt 150 for replacement.

The belt 150 may be a continuously driven belt with upper and lower runs, the upper run being supported by a stationary shaft 160. The conveyor support means may comprise one or more pistons 170 arranged to extend to move the conveyor belt between the working and access positions. In one embodiment, the pistons 170 may be fluid operated such as hydraulic or pneumatic.

The incorporation of low profile raising and lowering devices that utilize fluid source as a power source, as well as its ability to have adjustable inclination, while still retaining the ability to tilt the deck for service is very unique. The hydraulic drive design which is valveless, is very unique in the hydraulic industry, much less the hydrotherapy market.

Integration of the side steps and drive roller guarding into the deck frame allows these devices to directly follow the treadmill as the incline changes, yet are still quickly removable for access.

In one embodiment, the hydrotherapy device may include a water "filtering device" to trap debris.

In addition, the present invention relates to a hydrotherapy device in which the deck can be tilted upward from normal location to a service location with the aid of load offsetting devices and with minimal operator efforts. Deck design is such that open framework aids in easily cleaning the deck area and the open side allows easy replacement of the treadmill belt without removal of fixed structure parts which would not be possible without the claim (2) above that eliminates end support of the roller shaft and provides the automatic tensioning of the belt during operation.

Furthermore, the present invention relates to a hydrotherapy device in which the deck is equipped with infinite positioning devices to raise and lower the deck between the normal and the inclined position in such a manner as to provide an incline to the deck relative to the base. Uniqueness of design is such that an incline feature is incorporated without losing the ability to tilt the deck for service accessibility and cleaning.

In addition, the present invention relates to a hydrotherapy device which contains a "filtration area" integral to its return water side that incorporates a readily removable and serviceable "filter" that is designed to capture hair and other large debris before it can enter the return line and clog or inhibit performance of the final filtration system that is remote from the hydrotherapy device.

Also, the present invention relates to a hydrotherapy device which contains a deck assembly that has removable side steps that are biased to a tilt position to prevent the occupant from stepping off to the side of the treadmill belt. These steps and end guard plates are integral to the deck and move as a unit when the deck is inclined from the horizontal position, maintaining their proper orientation to the deck.

In addition, the present invention relates to a hydrotherapy device with adjustable hydro-jets that are ported integral to frame rails and are easily rotated out of position when not in use.

The skilled person will appreciate that many of the features discussed above in relation to any of the aspects of the invention are suitable for other aspects of the invention and the association of one feature with an aspect of the invention does not necessarily tie that feature to that aspect of the invention.

What is claimed is:

1. A door system comprising:

a receptacle having an open end;

a door frame having a top end, a first side, a second side, and a bottom end;

a closing mechanism, wherein the closing mechanism comprises a first engagement section operatively connected to a second engagement section;

wherein the first engagement section is connected to the open end of the receptacle;

wherein the second engagement section is connected to the door frame;

wherein the first engagement section includes a fixed pivot pin located on each corner of the open end;

wherein the second engagement section includes on each one of the first side and the second side of the top side of the door frame an upper sliding latch;

wherein the second engagement section includes on each one of the first side and the second side of the bottom side of the door frame a lower sliding latch;

wherein the upper sliding latch and the lower sliding latch of each side are interconnected by a drive shaft, the drive shaft having a first end and a second end;

wherein a removable handle is connected to first end of the drive shaft to simultaneously move the upper sliding latch and the lower sliding latch on one side of the door frame to engage with the corresponding fixed pivot pin on the open end of the receptacle; and wherein the handle moves from the drive shaft of the first side of the door frame to the drive shaft of the second side of the door frame to quickly convert from a left handle configuration to a right handle configuration or from a right handle configuration to a left handle configuration.

2. The door system of claim 1, wherein each upper sliding latch further comprises a guide plate including a slot to engage with the corresponding fixed pivot pin creating a pivot point.

3. The door system of claim 1, further comprising a cam connected to the handle to move the handle from a first position to a second position.

4. The door system of claim 1, further comprising a cap connected to the first end of the drive shaft to lock the position of the drive shaft when the handle moves to the other side of the door frame.

* * * * *